United States Patent [19]

Stephan

[11] Patent Number: 4,525,104

[45] Date of Patent: Jun. 25, 1985

[54] ROOF SUPPORT FOR TUNNEL EXCAVATOR

[75] Inventor: Peter Stephan, Essen, Fed. Rep. of Germany

[73] Assignee: Bergwerksverband GmbH, Essen, Fed. Rep. of Germany

[21] Appl. No.: 442,786

[22] Filed: Nov. 18, 1982

[30] Foreign Application Priority Data

Feb. 12, 1982 [DE] Fed. Rep. of Germany ..... 3204872

[51] Int. Cl.[3] ..... E21D 15/44; E21D 17/01

[52] U.S. Cl. ..... 405/290; 405/296

[58] Field of Search ..... 405/291-301, 405/290; 299/33

[56] References Cited

U.S. PATENT DOCUMENTS 3,192,722 7/1965 Herrmann et al. ..... 405/300

3,494,135 2/1970 von Hippel ..... 405/297

*Primary Examiner*—David H. Corbin

*Attorney, Agent, or Firm*—Karl F. Ross; Herbert Dubno

[57] ABSTRACT

A roof support for coal-mining apparatus or other tunnel-excavating equipment has a shield plate with several rearwardly diverging and deepening longitudinal grooves in its upper surface. The grooves are designed to carry off detritus as the support advances and are spaced closely enough to form ribs therebetween adapted to crush larger chunks of overburden landing thereon.

2 Claims, 3 Drawing Figures

ROOF SUPPORT FOR TUNNEL EXCAVATOR

FIELD OF THE INVENTION

My present invention relates to a roof support for tunnel-excavating equipment, e.g. apparatus used in coal mining.

BACKGROUND OF THE INVENTION

Such supports, e.g. as known from U.S. Pat. Nos. 3,847,438, 4,231,618 and 4,278,293, generally comprise shield plates with flat upper surfaces coming into contact with the mine roof when the plates are elevated by associated props usually designed as hydraulic jacks. As the excavation of a working face progresses, individual plates are lowered and moved forward in intermittent steps to keep pace with the advancing equipment. Each step may involve an advance by, say, a third or a fourth of the length of the plate in the direction of motion.

During such an advance, detritus from the momentarily unsupported overburden may fall onto the plate surface and remain thereon so as to prevent full-face contact between the plate and the mine roof upon the subsequent re-elevation of the support. The discontinuous contact may lead to further crumbling of the overburden and could even cause a partial collapse ahead of the shield plate.

It has already been proposed to solve this problem by providing the shield plate ahead of its leading edge with a wire mesh designed to intercept falling rock. Another suggestion entails the envelopment of the plate by a nondriven caterpillar chain. Both solutions are rather costly and neither of them has been found to be entirely satisfactory.

OBJECT OF THE INVENTION

The object of my present invention, therefore, is to improve the structure of such a roof support for avoiding the above-stated drawbacks.

SUMMARY OF THE INVENTION

In accordance with the present invention, the upper surface of my improved shield plate has a plurality of parallel grooves which extend in the direction of advance of the associated excavating equipment and terminate at a rear edge of the plate for facilitating the removal of detritus landing on its surface.

Advantageously, the grooves widen and deepen toward the rear edge of the shield plate so as, on the one hand, to facilitate a rearward sliding of the rock fragments and, on the other hand, to accommodate additional detritus when the grooves are partly filled after an initial advance.

BRIEF DESCRIPTION OF THE DRAWING

The above and other features of my present invention will now be described in detail with reference to the accompanying drawing in which.

SPECIFIC DESCRIPTION

Figure 1:
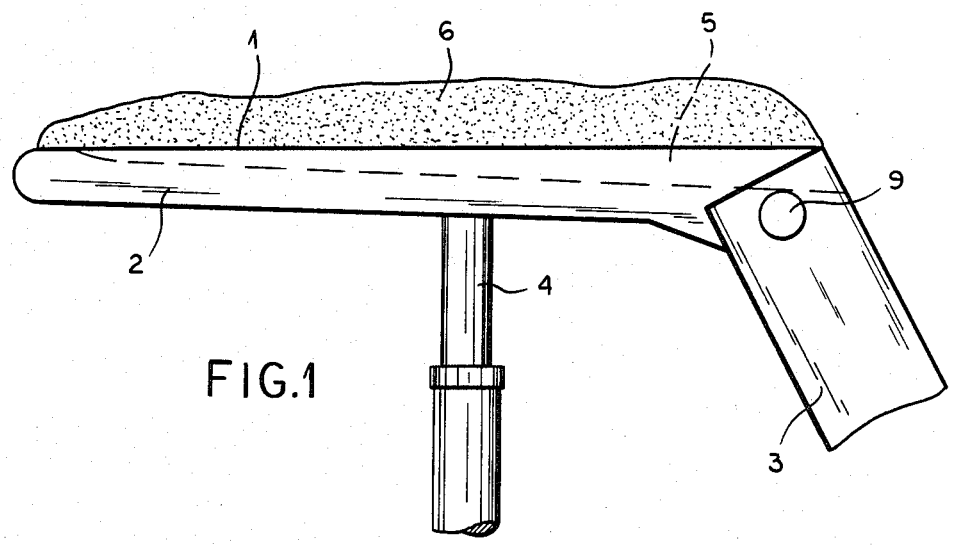
FIG. 1 is a side-elevational view of the upper part of a support for a mine roof including an improved shield plate according to my invention.
Figure 2:
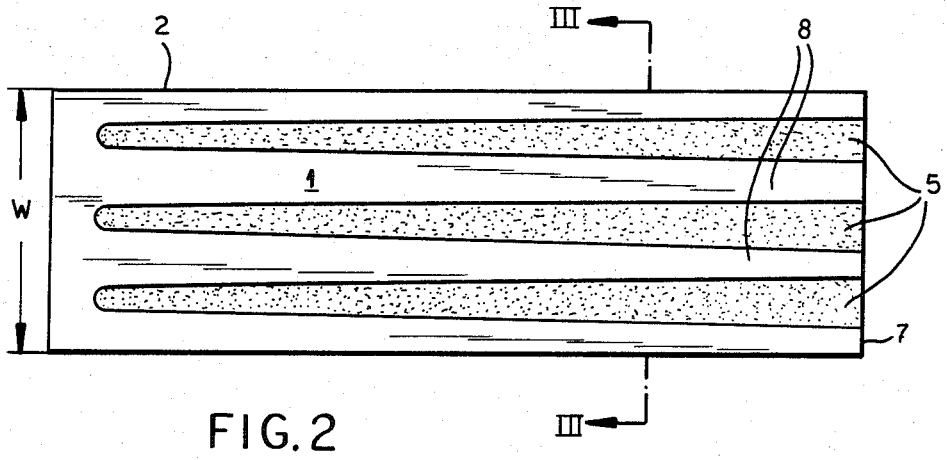
FIG. 2 is a top view of the shield plate shown in FIG. 1.

The roof support partially shown in FIG. 1 comprises a unitary horizontal shield plate 2 with an upper surface 1 in contact with overburden 6 against which it is propped by a hydraulic jack 4. A conventional fracture shield 3 is articulated at 9 to the rear end of plate 2.

Figure 3:
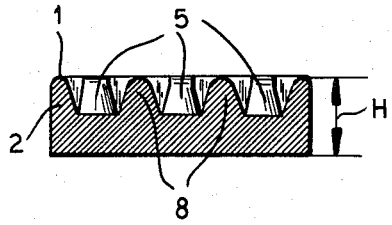
FIG. 3 is a cross-sectional view taken of the line III—III of FIG. 2.

In accordance with my invention, surface 1 of the rectangular plate 2 is formed with a plurality of longitudinally extending, parallel grooves 5 which open onto the rear edge 7 of that plate and progressively widen as well as deepen toward that edge. The grooves are separated by rearwardly tapering ribs 8 and are spaced apart closely enough to make the width of these ribs, at least in the vicinity of rear edge 7, less than the width of the grooves. This narrowing of the ribs renders them effective to crush larger rock fragments when the plate 2 is elevated by the jack 4 into contact with the roof formed by the overburden 6. The plate has a flat solid underside as clearly seen in FIG. 3.

With plate 2 assumed to have a width W of about 1.50 meters and a height H between about 20 and 40 cm (which is only about 10% greater than the height of conventional ungrooved shield plates used under comparable circumstances), three grooves 5 with a maximum width on the order of magnitude of height H will generally be satisfactory. The number of grooves could be increased, however, especially when the rock is relatively brittle.

With the shallow end of each groove 5 lying close to the front edge of plate 2, they extend virtually over the full length of that plate which substantially exceeds its width W.

I claim:

1. In tunnel-excavating equipment provided with a roof support comprising a unitary horizontal shield plate supported by a jack, the improvement wherein said shield plate has a flat solid underside and an upper surface provided with a plurality of parallel grooves extending in the direction of advance of the equipment, said grooves opening onto a rear edge of said shield plate for facilitating the removal of detritus landing on said upper surface and collecting in said grooves, said grooves progressively widening and deepening toward said rear edge, said grooves being separated by ribs tapering progressively to a width less than that of said grooves in the vicinity of said rear edge.

2. A shield plate as defined in claim 1 wherein said grooves extend over substantially the full length of said shield plate in said direction of advance but terminate short of a front edge of said shield plate.

* * * * *